US005803072A

United States Patent [19]

Strand

[11] Patent Number: 5,803,072

[45] Date of Patent: Sep. 8, 1998

[54] KITCHEN VENTILATOR

[75] Inventor: Markus Strand, Motala, Sweden

[73] Assignee: Aktiebolaget Electrolux, Stockholm, Sweden

[21] Appl. No.: 961,329

[22] Filed: Oct. 30, 1997

[30] Foreign Application Priority Data

Nov. 1, 1996 [SE] Sweden ..... 9604000

[51] Int. Cl.[6] ..... F24C 15/20

[52] U.S. Cl. ..... 126/299 R; 126/299 D; 454/906

[58] Field of Search ..... 126/299 R, 299 D, 126/21 R, 21 A, 299 F; 415/119; 417/312; 454/906; 431/114

[56] References Cited

U.S. PATENT DOCUMENTS

| | | | |
|---|---|---|---|
| 2,061,535 | 11/1936 | Davies | 454/906 |
| 3,688,867 | 9/1972 | Antonetti et al. | 417/312 |
| 4,089,328 | 5/1978 | Bergmark et al. | 126/299 D |
| 5,027,790 | 7/1991 | Sheng | 126/299 R |
| 5,230,327 | 7/1993 | Jang | 126/299 R |
| 5,311,857 | 5/1994 | Chang | 126/299 D |
| 5,720,274 | 2/1998 | Brunner et al. | 126/299 R |

*Primary Examiner*—James C. Yeung
*Attorney, Agent, or Firm*—Pearne, Gordon, McCoy & Granger LLP

[57] ABSTRACT

A kitchen ventilator, including a collecting box (11) supporting on its upper side a fan casing (10) enclosing a chamber which, by means of an essentially vertical partition (21), delimits an inlet channel (23) and a fan housing with an outlet channel (18), respectively. The collecting box (11), via an outlet opening (19) provided in its upper wall, is connected to the inlet channel (23) and the fan housing contains an impeller (16) rotatable in a vertical plane. The inlet side of the impeller (16) is connected to the inlet channel (23) via an essentially circular opening (20) provided in the partition (21) and the outlet side of the impeller (16) is connected to the outlet channel (18). Each of the inlet and outlet channels (23,18) is formed in inserts (22,17) made of sound-absorbing material. The outlet opening (19) in the collecting box (11) is displaced laterally relative to the opening (20) in the partition (21) and the inlet channel (23) curves in the direction of rotation of the impeller (16) so that the incoming flow is deflected in the direction of rotation.

5 Claims, 2 Drawing Sheets

KITCHEN VENTILATOR

BACKGROUND OF THE INVENTION

The present invention relates to a kitchen ventilator including a collecting box supporting, on its upper side, a fan casing enclosing a chamber which, by means of a mainly vertical partition, delimits an inlet channel and a fan housing with an outlet channel. The collecting box, via an outlet opening provided in its upper wall, is connected to the inlet channel. The fan housing contains a fan rotatable in a vertical plane, the inlet side of which is connected to the inlet channel via an essentially circular opening provided in the partition and the outlet side of which is connected to the outlet channel. The inlet and outlet channels are formed by inserts made of sound-absorbing material.

Devices of the kind indicated above are provided for the purpose of removing fumes, vapors and the like emitted during cooking from frying pans and kettles on top of a range or from an oven included in the range. Most often, such a ventilator is disposed above the range cooking surface at a height permitting convenient handling of the pans and kettles or the like placed on the cooking surface without reducing, to a bothersome extent, the ability of the kitchen ventilator to collect the fumes, vapors and the like.

Often, kitchen ventilators for domestic use have a relatively simple construction, including a fan driven by an electric motor housed in a fan housing provided with an inlet channel and an outlet channel. Often, the fan housing is disposed on top of a flat box-shaped collecting chamber which extends above the cooking surface for the purpose of collecting fumes, vapors and the like from the space adjacent to the cooking surface. The inlet channel is connected to the collecting chamber to convey the fumes, vapors and the like to the inlet of the fan to be forwarded to an outlet which can open to the surrounding room (charcoal filter fan) or into a ventilation duct leading into the open air.

A common goal of kitchen ventilators is to simultaneously achieve two competing desires, namely achieving adequate suction power and a low noise level. If suction power is to be achieved, most often, the result will be that the noise from the fan and the flowing air reaches annoyingly high levels. Therefore, in more expensive models of kitchen ventilators sound absorbing material has been provided in order to reduce the noise level. An example of a kitchen ventilator of this kind is presented in EP-B1-0149053.

EP-A1-0596846 discloses a kitchen ventilator wherein a fan is disposed in a housing connected to an outlet. The inlet to the fan has the shape of a circular opening in a partition which separates the fan housing from an inlet channel conveying fumes, vapors and the like from a collecting box.

SUMMARY OF THE INVENTION

An object of the present invention is to offer an effective way of handling the noise problems associated with kitchen ventilators without causing the construction of the ventilators to become more complicated and hence more expensive.

The present invention provides a kitchen ventilator having a collecting box supporting, on its upper side, a fan casing that defines a chamber. The chamber, by means of an essentially vertical partition, separates an inlet channel from an outlet channel. The collecting box has an outlet opening provided in an upper wall which is connected to the inlet channel. The fan casing contains an impeller rotatable in a vertical plane and having an inlet side, an outlet side and a direction of rotation. The inlet side of said impeller is connected to the inlet channel via an opening in the partition and the outlet side of the impeller is connected to the outlet channel. The inlet and outlet channels are formed by an inlet insert and an outlet insert respectively. The inlet and outlet inserts are made of sound-absorbing material. The outlet opening in the collecting box is displaced laterally relative to the opening in the partition. The inlet channel has a curved shape adapted to the direction of rotation of the impeller so that the air flowing through said inlet channel is deflected in the direction of rotation.

According to another aspect of the invention, the inlet channel is shaped such that, at the opening in the partition, the inlet channel extends laterally outside of the opening whereas, at the opposite side of the opening, the inlet channel is essentially coextensive with the opening.

According to another aspect of the invention, a front wall of the fan casing, which delimits the inlet channel, axially slopes from an upper narrow portion to a lower broad portion. The front wall extends from the outlet opening provided in the collecting box to the inlet channel.

According to another aspect of the invention, the inlet insert has walls delimiting the inlet channel. The inlet insert walls deflect towards one another adjacent the outlet opening in the collecting box.

According to yet another aspect of the invention, on the side where the inlet channel extends outside of the opening in the partition, the inlet insert wall essentially follows a parabolic curve. The highest point of the parabolic curve is disposed above an upper edge of the opening in the partition (21). The highest point is located above said upper edge a distance of about a quarter of the diameter of the opening and is positioned on a vertical line generally intersecting the right-hand side of the channel wall at the outlet opening from the collecting box. The inlet insert wall essentially follows the right-hand edge of the opening in the partition.

BRIEF DESCRIPTION OF THE DRAWINGS

These and further features of the present invention will be apparent with reference to the description and drawings, wherein.

DETAILED DESCRIPTION OF THE PREFERRED EMBODIMENT

Figure 1:
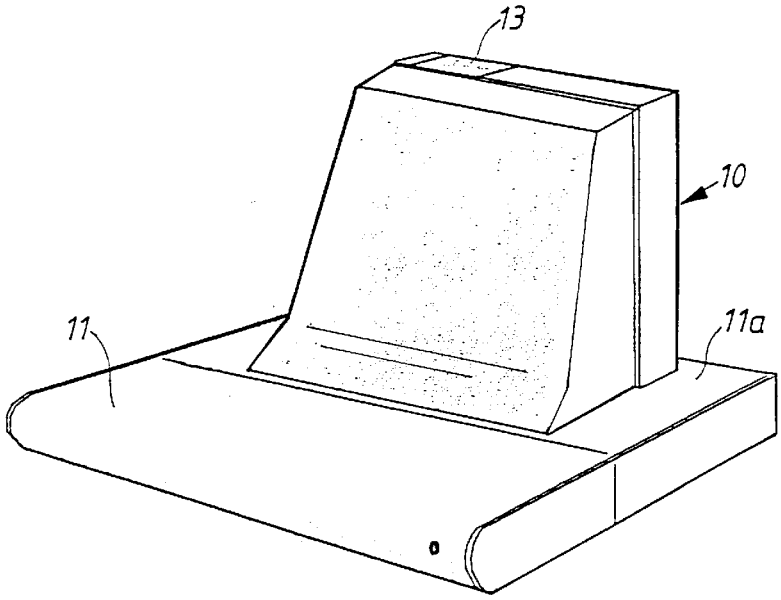
FIG. 1 is a schematic perspective view of a device according to the present invention.

FIG. 1 shows a kitchen ventilator of a conventional exterior design with a fan casing 10 disposed on top of a collecting box 11. The kitchen ventilator can be mounted separately on a wall above a range or can be combined with a spice-rack or the like secured to the wall. The collecting box 11 encloses a collecting channel 12 (FIG. 2) provided to collect fumes, vapors and the like drawn into the collecting box via suitable channels, e.g. a larger opening covered by a filter for separating fat. A detailed description of the collecting box with inlet openings, filter and the like is not provided herein as such structures are well known in the art and do not form a part of the present invention.

On top of the fan casing 10, an outlet opening 13 is provided through which air is discharged either to the surrounding space after having passed a charcoal filter (not shown) or to a ventilation duct leading into the open air.

Figure 2:
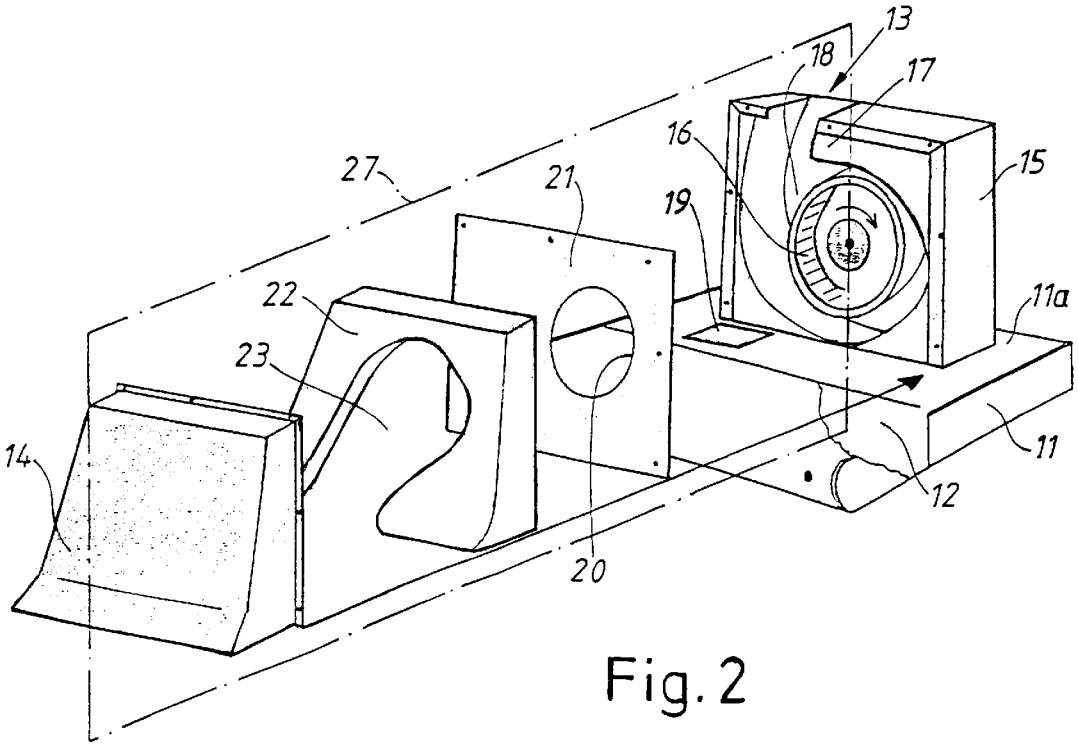
FIG. 2 is an exploded perspective view of the device of FIG. 1.

As better shown in FIG. 2, the fan casing 10 comprises a front fan casing portion 14 and a rear fan casing portion 15, which is shaped like a rectangular box. The portions 14, 15 are joined by means of screws or the like. Disposed in the rear fan casing portion 15 is an impeller 16 which is rotated by an electric motor (not shown). An insert 17 is provided in the rear fan casing portion 15. The insert 17 is formed from sound absorbing material. The insert 17 forms a spiral outlet channel 18 which extends around the impeller 16 and opens into the outlet opening 13.

The front fan casing portion 14 forms an inlet housing used to convey the fumes, vapors and the like from an outlet opening 19 of the collecting box 11 to an inlet opening 20 to the impeller 16. The inlet housing is displaced laterally with respect to an axial plane of symmetry 27 through the impeller 16 that extends perpendicularly to a plane surface 11*a* supporting the fan casing 10. The inlet opening 20 is provided in a partition 21 separating the front and rear fan casing portions 14, 15 and situated just in front of the impeller 16. The impeller 16 is of the radial fan type, wherein air is drawn in axially and blown-out radially.

The front fan casing portion 14 has an insert 22 of sound absorbing material forming a curved inlet channel 23. The curved shape of the inlet channel 23 between the collecting box outlet opening 19 and the opening 20 in the partition 21 leading to the impeller 16 is adapted to the direction of rotation of the impeller 16 so that the inlet air flow is deflected in the direction of rotation of the impeller 16. As a result, the air flow will obtain a rotating motion prior to reaching the impeller 16, thus facilitating the continued flow movement through the impeller 16, the outlet channel 18 and the outlet opening 13. In this way, the efficiency of the ventilator will increase.

Sound absorbing materials for the inserts 17 and 22 are, for example, glass-wool and polyurethane. Since the inserts 17 and 22 form the inlet and outlet channels 23 and 18, they will be exposed to air which is both humid and carrying fat particles. To protect the inserts 17 and 22, a protecting layer, which is moisture repellant and fat proof, is applied to the surfaces forming the channels 18 and 23. One example of such a protecting layer is a thin film of polyurethane applied by spraying the air contacting parts of the inserts 17 and 22.

Figure 3:
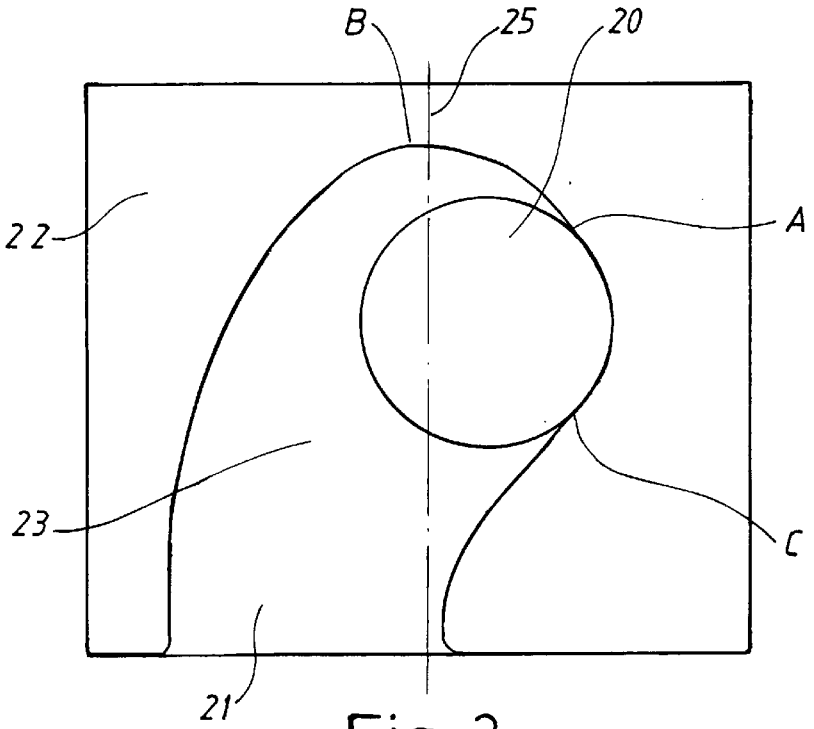
FIG. 3 is a front elevational view of a sound absorbing insert and a partition behind; and, FIG. 4 is a side elevational view of the sound absorbing insert of FIG. 3.
Figure 4:
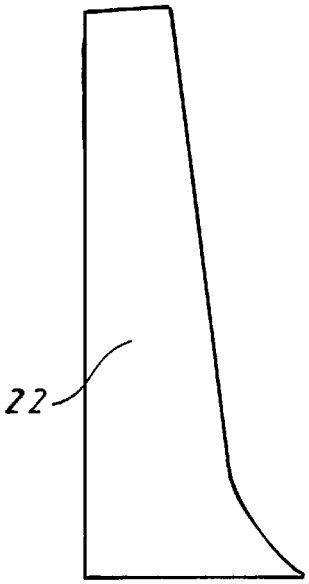

Now, reference is made to FIGS. 3–4 showing more specifically the design of the inlet channel 23. In FIG. 3, which shows the insert 22 and the partition 21 behind, the inlet channel 23 is shown to curve or bend from left to right. The opening 20 in the partition 21 is displaced to the right with respect to a vertical line of symmetry 25. The task here is to give to the inlet channel a shape that permits a flow as large as possible without the noise level becoming annoyingly high. In order to increase the flow of air and fumes, it has been found to be advantageous to convey air to the inlet opening 20 from above the inlet opening 20, as seen in the drawing, in addition to directing air flow directly from the outlet opening 19 to the inlet opening 20. To this end, the inlet channel 23 extends in a curve to the left of the inlet opening 20 following essentially a parabolic curve to a point A situated at the edge of the opening at about 2 o'clock, if for a moment the opening is looked upon as a clock. The highest point B of the parabolic curve is situated essentially at the point where the parabolic curve intersects the line of symmetry 25. In addition, this highest point B is situated at a distance above the upper edge of the opening 20 (in the direction of the line of symmetry 25) which is about a quarter of the diameter of the opening 20. The opposite, right-hand side of the inlet channel 23, follows the curvature of the opening to a point C at about 5 o'clock and continues from there towards the right-hand side of the outlet opening 19 in a smooth curve directed towards the channel 23.

Adjacent to the outlet opening 19 the two channel walls on opposite sides of the opening 19 deflect towards one another for the smooth guidance of the air from the opening 19 and into the inlet channel 23. The right-hand edge of the outlet opening 19 from the collecting box 11 coincides essentially with the point of intersection of the line of symmetry 25 and the plane surface 11*a*. The described shape of the inlet channel 23 contributes in counteracting tendencies of turbulence and the associated reduction of the flow. Such turbulence is further counteracted by giving the insert 22 a design as shown in FIG. 4. Due to the fact that, as seen from the side, the insert 22 and, hence the inlet channel 23, narrows in an upward direction to obtain a funnel-like shape, incoming air and fumes are led from the outlet opening 19 to the inlet opening 20 to the impeller 16 in a way which is advantageous from an aerodynamic point of view. In addition, displacing the openings 19 and 20 laterally with respect to one another minimizes or reduces direct transmission of undesired fan noise to the inlet side of the kitchen ventilator and permits damping of noise by the sound absorbing material forming the side walls of the inlet channel 23.

When the impeller 16 is put into operation, the impeller 16 rotates in the direction indicated by an arrow (FIG. 2) and air is drawn into the collecting box 11, through the outlet opening 19 from the collecting box 11, and into the inlet channel 23. Due to the curved shape of the inlet channel 23 and the lateral displacement of the outlet opening 19 relative to the impeller 16, the incoming flow is given a rotating motion in the direction of rotation of the impeller 16. The flow exits the channel 23 via the opening 20 in the partition 21 as a rotating flow which is drawn by the impeller 16 to be conveyed into the spiral outlet channel 18 from which the flow exits via the outlet opening 13.

Since the shape of the insert 22 completely fills the space between the front fan casing portion 14 and the partition 21, the greatest possible utilization of the sound absorbing material is obtained which results in the efficient damping of undesired noise. At the same time, an increase in complexity of the present soundproofed kitchen ventilator as compared to a conventional unsound-proofed ventilator is avoided. This means that the positive results with regard to the efficiency and low noise level of the ventilator are obtained without any significant increase in cost associated with the manufacture of such kitchen ventilator.

While the preferred embodiment of the present invention is shown and described herein, it is to be understood that the same is not so limited but shall cover and include any and all modifications thereof which fall within the purview of the invention as defined by the claims appended hereto.

What is claimed is:

1. A kitchen ventilator, comprising a collecting box (11) supporting on its upper side a fan casing (10), said fan casing defining a chamber which, by means of an essentially vertical partition (21), separates an inlet channel (23) from an outlet channel (18), said collecting box (11) having an outlet opening (19) provided in an upper wall (11*a*) of said collecting box (11), said outlet opening (19) being connected to the inlet channel (23), said fan casing 10 containing an impeller (16) rotatable in a vertical plane and having an inlet side, an outlet side and a direction of rotation, the inlet side of said impeller (16) being connected to the inlet channel (23) via an opening (20) in the partition (21), the outlet side of said impeller being connected to the outlet channel (18), said inlet and outlet channels (23,18) being formed by an inlet insert and an outlet insert (22,17) respectively, said inlet and outlet inserts (22,17) being made of sound-absorbing material, wherein the outlet opening (19) in the collecting box (11) is displaced laterally relative to the opening (20) in the partition (21) and wherein the inlet channel (23) has a curved shape adapted to the direction of rotation of the impeller (16) so that the air flowing through said inlet channel (23) is deflected in said direction of rotation.

2. A kitchen ventilator according to claim 1, wherein the inlet channel (23) is shaped such that, at the opening (20) in the partition (21), the inlet channel (23) extends laterally outside of the opening (20) whereas, at the opposite side of the opening (20), the inlet channel (23) is essentially coextensive with the opening (20).

3. A kitchen ventilator according to claim 2, wherein a front wall (14) of the fan casing (10), which delimits the inlet channel (23), axially slopes from an upper narrow portion to a lower broad portion, said front wall (14) extending from the outlet opening (19) provided in the collecting box (11) to the inlet channel (23).

4. A kitchen ventilator according to claim 3, wherein the inlet insert (22) has walls delimiting the inlet channel (23) said inlet insert walls deflecting towards one another adjacent the outlet opening (19) in the collecting box (11).

5. A kitchen ventilator according to claim 4, wherein at the side where the inlet channel (23) extends outside of the opening (20) in the partition (21), the inlet insert wall essentially follows a parabolic curve, the highest point (B) of said parabolic curve being disposed above an upper edge of the opening (20) in the partition (21), said highest point (B) located above said upper edge a distance of about a quarter of the diameter of said opening (20) and being positioned on a vertical line (25) generally intersecting the right-hand side of the channel wall at the outlet opening (19) from the collecting box (11), and said inlet insert wall essentially follows the right-hand edge of the opening (20) in the partition (21).

* * * * *